US006174243B1

(12) United States Patent
Choi

(10) Patent No.: US 6,174,243 B1
(45) Date of Patent: Jan. 16, 2001

(54) GOLF BALL FEEDER FOR USE IN GOLF PRACTICE COURT

(76) Inventor: Myung Choi, 545-50 Suyoo 6-dong, Kangbuk-ku, Seoul (KR)

( * ) Notice: Under 35 U.S.C. 154(b), the term of this patent shall be extended for 0 days.

(21) Appl. No.: 09/338,361

(22) Filed: Jun. 23, 1999

(30) Foreign Application Priority Data

Feb. 10, 1999 (KR) ..... 99-4647
May 3, 1999 (KR) ..... 99-15828

(51) Int. Cl.[7] ..... A63B 57/00
(52) U.S. Cl. ..... 473/137; 473/134
(58) Field of Search ..... 473/132–137

(56) References Cited

U.S. PATENT DOCUMENTS 3,003,770 * 10/1961 Jones ..... 473/134
4,265,453 * 5/1981 Loof ..... 473/134
4,957,296 * 9/1990 Turnidge et al. ..... 473/137
4,981,299 * 1/1991 Petrillo ..... 473/136
5,348,305 * 9/1994 Lowe ..... 473/133
5,674,130 * 10/1997 Egan ..... 473/134
5,971,862 * 10/1999 Yates ..... 473/137

* cited by examiner

*Primary Examiner*—Steven Wong
(74) *Attorney, Agent, or Firm*—Baker Botts L.L.P

(57) ABSTRACT

A golf ball feeder includes a hopper for storing a plurality of golf balls therein. The hopper has an opening. A guide chute is positioned below the hopper to receive the golf balls from the opening of the hopper. The golf balls flow along the guide chute. An outlet chute is connected to the guide chute to pass over the golf balls flowed from the guide chute to the outside. A stopper is formed in a boundary region between the guide chute and the outlet chute to stop flowing of the golf balls. A golf ball lifting unit is positioned below the stopper to free one of the golf balls from the stopper. The golf ball lifting unit has a rod. A tee up member is hinged at an outlet side of the outlet chute to receive the golf ball from the outlet chute and put the golf ball on a tee. The golf balls are liable to be stuck in the hopper. Therefore, the golf ball feeder further includes a golf ball releasing unit to release the stuck state of the golf balls in connection with the rod of the golf ball lifting unit.

2 Claims, 7 Drawing Sheets

GOLF BALL FEEDER FOR USE IN GOLF PRACTICE COURT

BACKGROUND OF THE INVENTION (a) Field of the Invention

The present invention relates to a golf ball feeder for use in a golf practice court and, more particularly, to a golf ball feeder which can feed golf balls onto a tee or a mat only with one-touch movement of a golf player without using any electrical energy, and enables the golf player to selectively practice a tee-shot or a second shot.

(b) Description of the Related Art

Generally, in the usual golf practice court, a golf ball feeder is provided at each mat to continuously feed golf balls thereto. This allows a golf player to selectively practice a tee-shot or a second shot.

The golf ball feeder is usually driven by using a separate motor as its power source. In addition, this motor-based golf ball feeder should be inevitably installed with relevant facilities incidental to the separate motor. These facilities may include an elastic member and a rotating arm for picking up the golf ball.

However, in the above structure, electrical energy should be consumed for operating the motor and noise can occur. Furthermore, the incidental facilities cause complicated structure or device failure. For example, the elastic member is liable to lose its tensional strength, resulting in abnormal operation of the device and making the need of repairing. The rotating arm may be broken in a collision against the golf club and the abrasive resistance working at its rotating portion may lead to extravagance in energy.

On the other hand, the golf ball feeder is usually provided with a hopper for storing golf balls therein and relaying them to a golf ball feeding mechanism. The size of the hopper is practically limited so that the golf balls contained therein are liable to be stuck by their own weights or tares. This prevents the golf ball from being smoothly fed to the suitable place.

In this case, the golf player should hit a main body of the golf ball feeder by the golf club to release the stuck state of the golf balls. With repeated hitting operations, the main body of the golf ball feeder is deteriorated in its durability, resulting in the device trouble.

SUMMARY OF THE INVENTION

It is an object of the present invention to provide a golf ball feeder which can feed golf balls onto suitable places without using any electrical energy.

It is another object to provide a golf ball feeder which can release the stuck state of golf balls merely by one-touch movement of a golf player.

These and other objects may be achieved by a golf ball feeder having a hopper for storing a plurality of golf balls therein. The hopper has an opening. A guide chute is positioned below the hopper to receive the golf balls from the opening of the hopper. The golf balls flow along the guide chute. An outlet chute is connected to the guide chute to pass over the golf balls flowed from the guide chute to the outside. A stopper is formed in a boundary region between the guide chute and the outlet chute to stop flowing of the golf balls. A golf ball lifting unit is positioned below the stopper to free one of the golf balls from the stopper. The golf ball lifting unit has a rod. A tee up member is hinged at an outlet side of the outlet chute to receive the golf ball from the outlet chute and put the golf ball on a tee.

The golf balls are liable to be stuck in the hopper. Therefore, the golf ball feeder may further include a golf ball releasing unit to release the stuck state of the golf balls in connection with the rod of the golf ball lifting unit.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or the similar components, wherein.

DETAILED DESCRIPTION OF THE PREFERRED EMBODIMENTS

Preferred embodiments of this invention will be explained with reference to the accompanying drawings.

Figure 1:
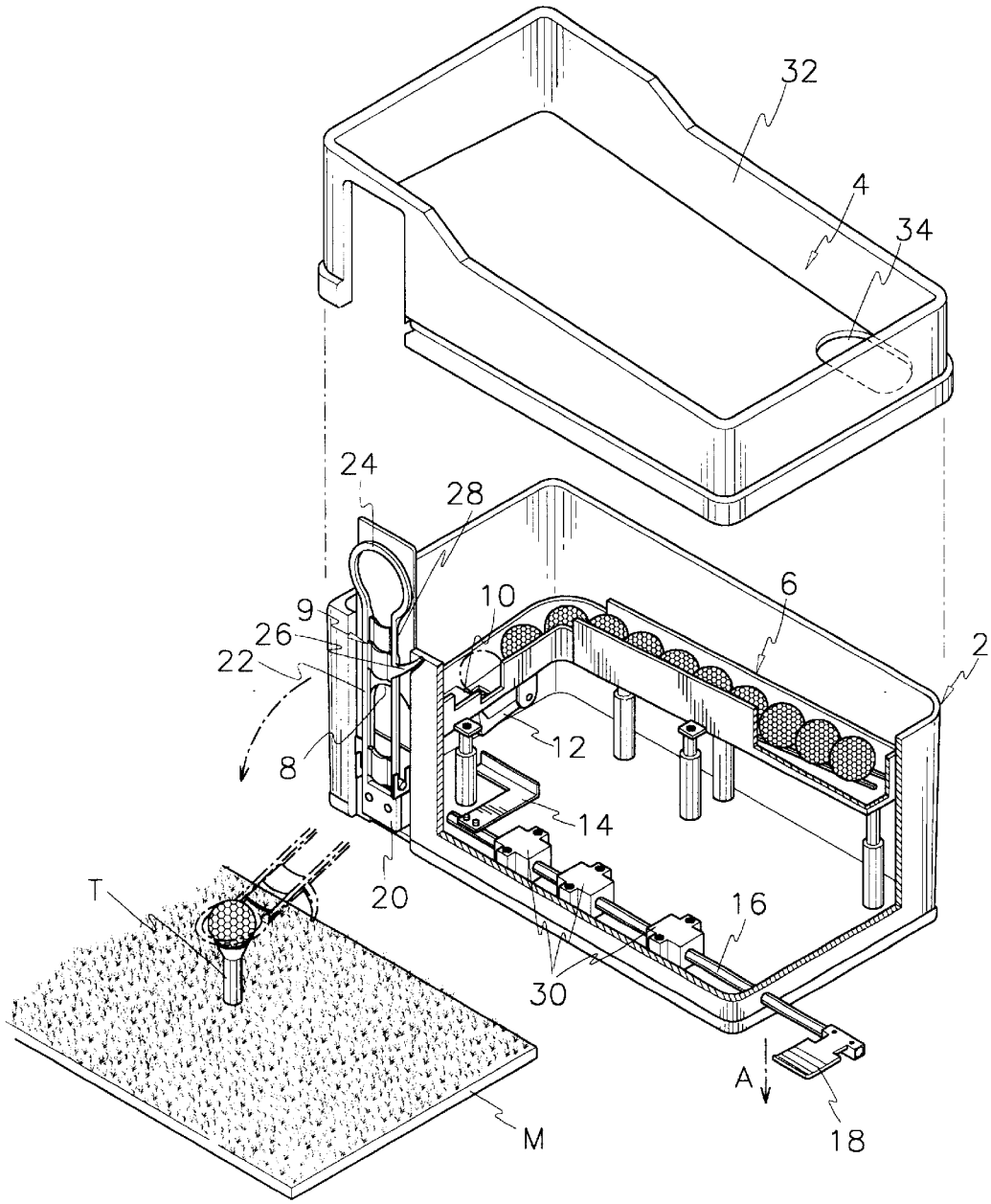
FIG. 1 is a partially sectional perspective view of a golf ball feeder according to a first preferred embodiment of the present invention.

FIGS. 1 to 4 are views illustrating a golf ball feeder according to a first preferred embodiment of the present invention. As shown in FIG. 1, the golf ball feeder is provided with a golf ball feeding mechanism enclosed in a case 2. The case 2 is to protect the golf ball feeding mechanism from an external impact or shock.

The case 2 may be formed with a plate or composite members based on thin metal or synthetic resin materials. The case 2 is covered with a hopper 4 having an empty space 32 for storing predetermined numbers of golf balls therein and an opening 34 for relaying the golf balls to the golf ball feeding mechanism. The hopper 4 may be formed with rectangular or cylindrical shape to fit in with that of the case 2.

The golf ball feeding mechanism disposed in the case 2 includes a guide chute 6 positioned below the hopper 4 to receive the golf balls from the opening 34. An outlet chute 8 and a tee up member 9 are serially connected to the guide chute 6. The guide chute 6 slopes down to the outlet chute 8 to deliver the golf balls flowed from the opening 34 of the hopper 4 to the outlet chute 8. The tee up member 9 is to put the golf balls issued from the outlet chute 8 onto a tee T.

The guide chute 6 may be formed with one bodied member or two or more bodied member where the body components may be cross-arranged to prevent the golf balls from rapidly moving therealong.

Figure 2:
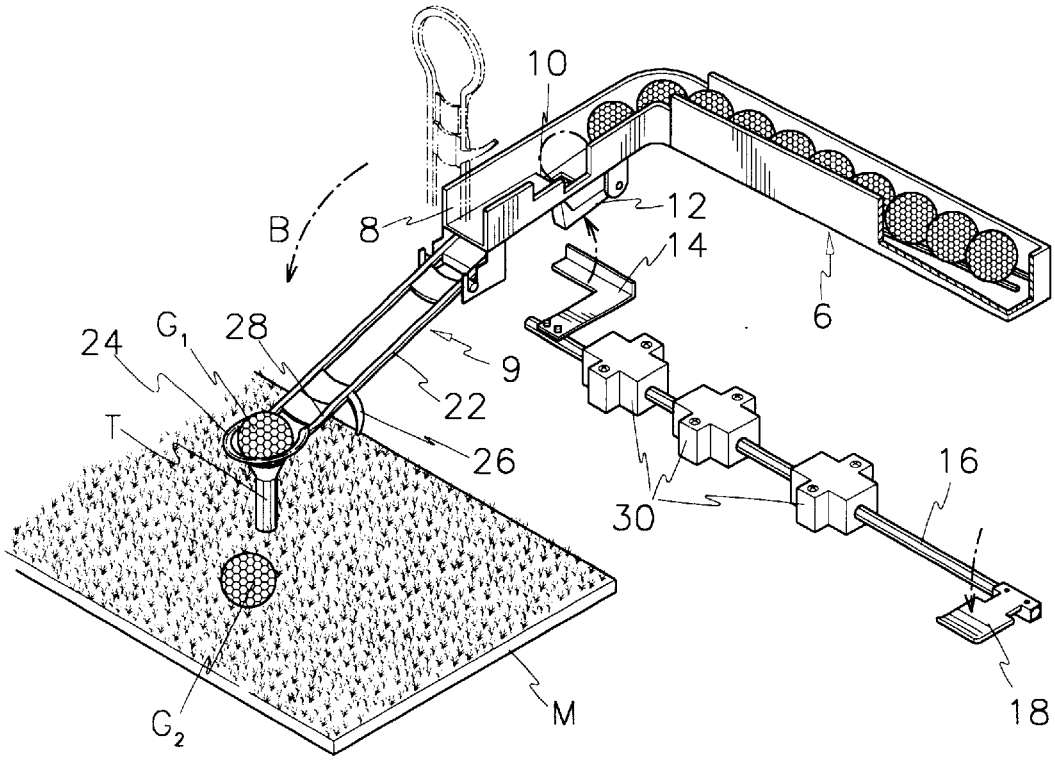
FIG. 2 is a partially amplified view of the golf ball feeder shown in FIG. 1.

As shown in FIG. 2, the guide chute 6 is displaced with respect to the outlet chute 8 such that the former is positioned lower than the latter. Owing to the displacement, the golf balls moved along the guide chute 6 can be stopped against the outlet chute 8. That is, the guide chute 6 terminates in a displaced section, called herein a stopper 10.

In this structure, it can be easily shown that the golf ball stopped against the stopper 10 should be artificially freed therefrom. For this purpose, in this preferred embodiment, a lift 12 is provided under the golf ball stop position to move the golf ball upward. The lift 12 has an end hinged at a bottom side of the guide chute 6 and an opposite end capable of passing through the guide chute 6.

The lift 12 is structured to be in a lowering state with respect to the hinged portion. A pushing member 14 is provided under the lift 12 to push it upward. The pushing member 14 is fixed to a polygonal or cylindrical-shaped rod 16. The rod 16 is in turn fixed onto a bottom portion of the case via a plurality of fixtures 30 such that it can be rotated. When the rod 16 is rotated, the pushing member 14 fixed to the rod 16 is also rotated to thereby move the lift 12 upward.

For this operation, the pushing member 14 and the rod 16 may be made into one body or separately manufactured and then combined into one body. The pushing member 14 is eccentrically protruded from the rod 16 such that it can be always in a lowering state with no external force applied thereto.

The rod 16 is extended to the outside of the case 2 to thereby form a power-receptor 18 onto which a golf player can apply force to rotate the rod 16. The power-receptor 18 may be formed with the same material as the rod 16 or combined with another member.

The tee up member 9 is hinged at an outlet side of the outlet chute 8 such that it can always intercept the outlet portion of the outlet chute 8. For the intercepting purpose, in this preferred embodiment, a weight 20 is hanged to a bottom side of the tee up member 9. With this structure, a ball guide portion 22 of the tee up member 9 can be kept to face upward.

The guide portion 22 is formed with a double-line member where the line components are arranged with a distance smaller than the diameter of the golf ball to prevent dropping of the golf ball therefrom. The double-line member terminates in a ring-shaped portion 24 for receiving the golf ball and putting it onto the tee T. Admittedly, the ring-shaped portion 24 has a diameter larger than that of the golf ball to allow passage of the golf ball.

In the meantime, in case the golf player wants to play or practice a second shot, the golf ball G1 put on the tee T remains in its place and another golf ball G2 is fed through the outlet chute 8. The newly fed golf ball G2 collides against the previously fed golf ball G1 and drops onto a mat M. A mat up member 26 is provided at a side portion of the double-line member to guide the dropping ball on the proper place. In addition, for the smooth dropping of the golf ball G2, a curved portion 28 is formed adjacent to the mat up member 26 toward the ring-shaped portion 24.

In operation, when predetermined numbers of golf balls are put in the hopper 4, they pass through the opening 34 of the hopper 4 onto the guide chute 6 and slide along the guide chute 6 to the outlet chute 8.

A front golf ball then stops against the stopper 10 and intercepts ongoing of other ensuing golf balls. In this way, as shown in FIG. 1, the golf balls introduced into the guide chute 6 come to be in a rest state.

Figure 3:
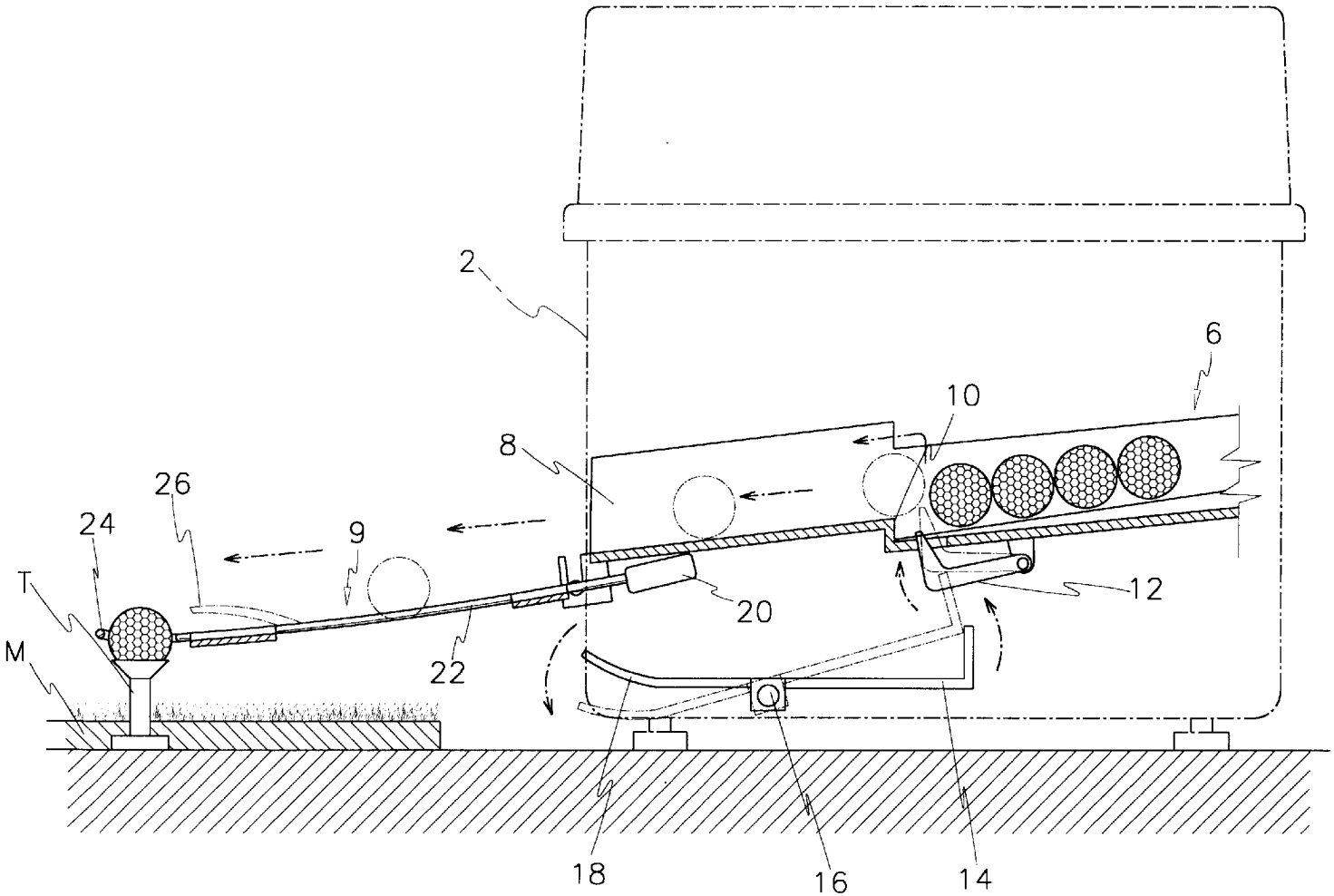
FIG. 3 is a side sectional view of the golf ball feeder shown in FIG. 1.
Figure 4:
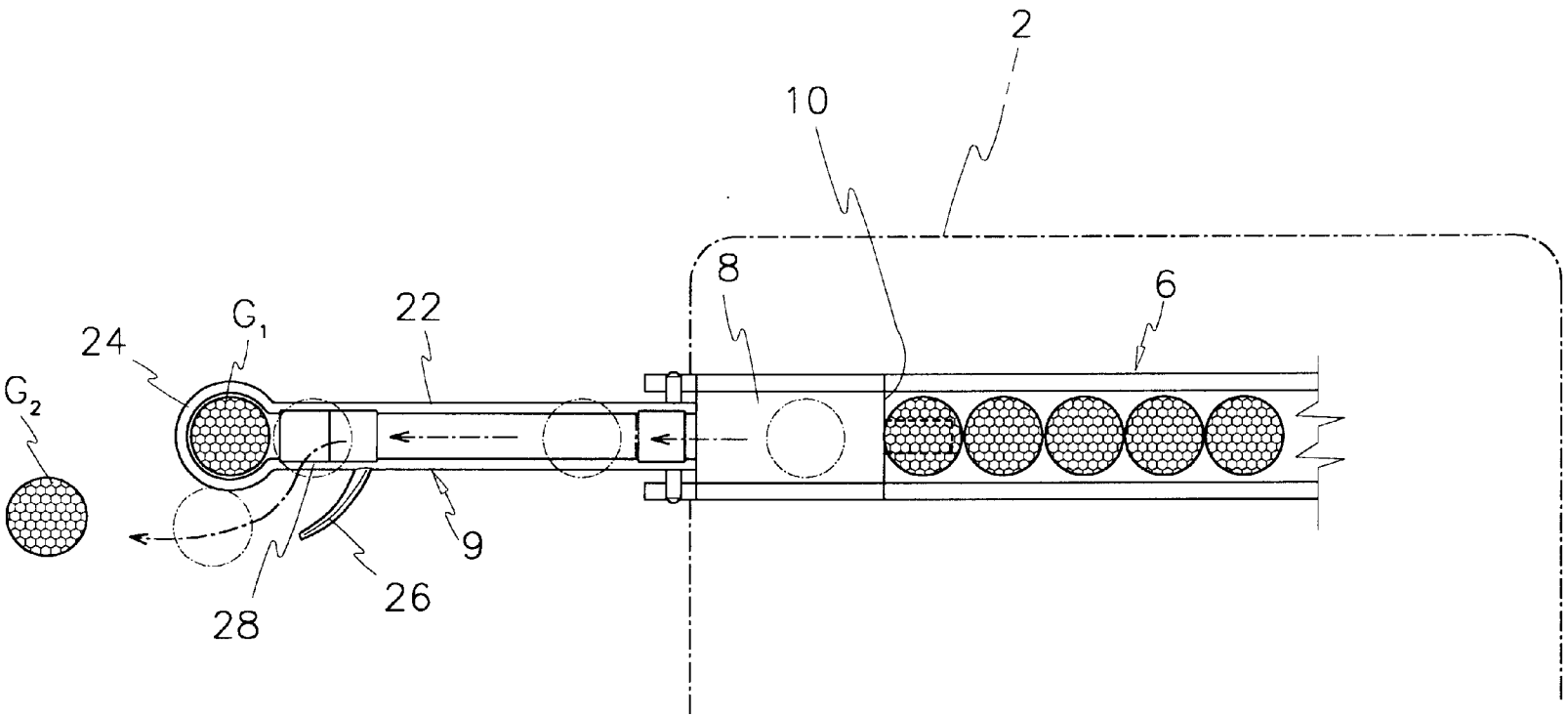
FIG. 4 is a plan view of the golf ball feeder shown in FIG. 1.

As shown in FIG. 3, when the tee T is fixed at a suitable position and the golf player applies force onto the power receptor 18 by his foot or a golf club, the rod 16 is rotated. With the rotation of the rod 16, the pushing member 14 fixed to the rear end of the rod 16 is in turn rotated so as to push the lift 12 upward. As a result, the lift 12 frees the front golf ball from the stopper 10. This golf ball then rolls along the outlet chute 8 and collides against the tee up member 9. Owing to the colliding impact, the tee up member 9 is outstretched toward the tee in an arrow B direction shown in FIG. 2. As a result, the golf ball is relayed from the outlet chute 8 to the tee up member 9 and put on the tee T via the ring-shaped portion 24.

In the ensuing tee shot practices, the golf ball feeding process described above can be repeated in the same manner so that the golf player can continuously play the desired numbers of tee shots.

On the other hand, in case the golf player wants to play a second shot, as shown in FIG. 2, the previously fed golf ball G1 remains to be in its state and another golf ball G2 is introduced onto the tee up member 9 through the previously described process. This golf ball G2 slides along the tee up member and collides against the previously fed golf ball G1. Due to the colliding impact, the golf ball G2 drops onto a suitable position of the mat M long the curved portion 28 by the guidance of the mat up member 26.

All the way, in case another golf ball is not fed, the outstretched tee up member 9 returns to its original position by the operation of the weight 20 to again intercepts the outlet portion of the outlet chute 8.

Figure 5:
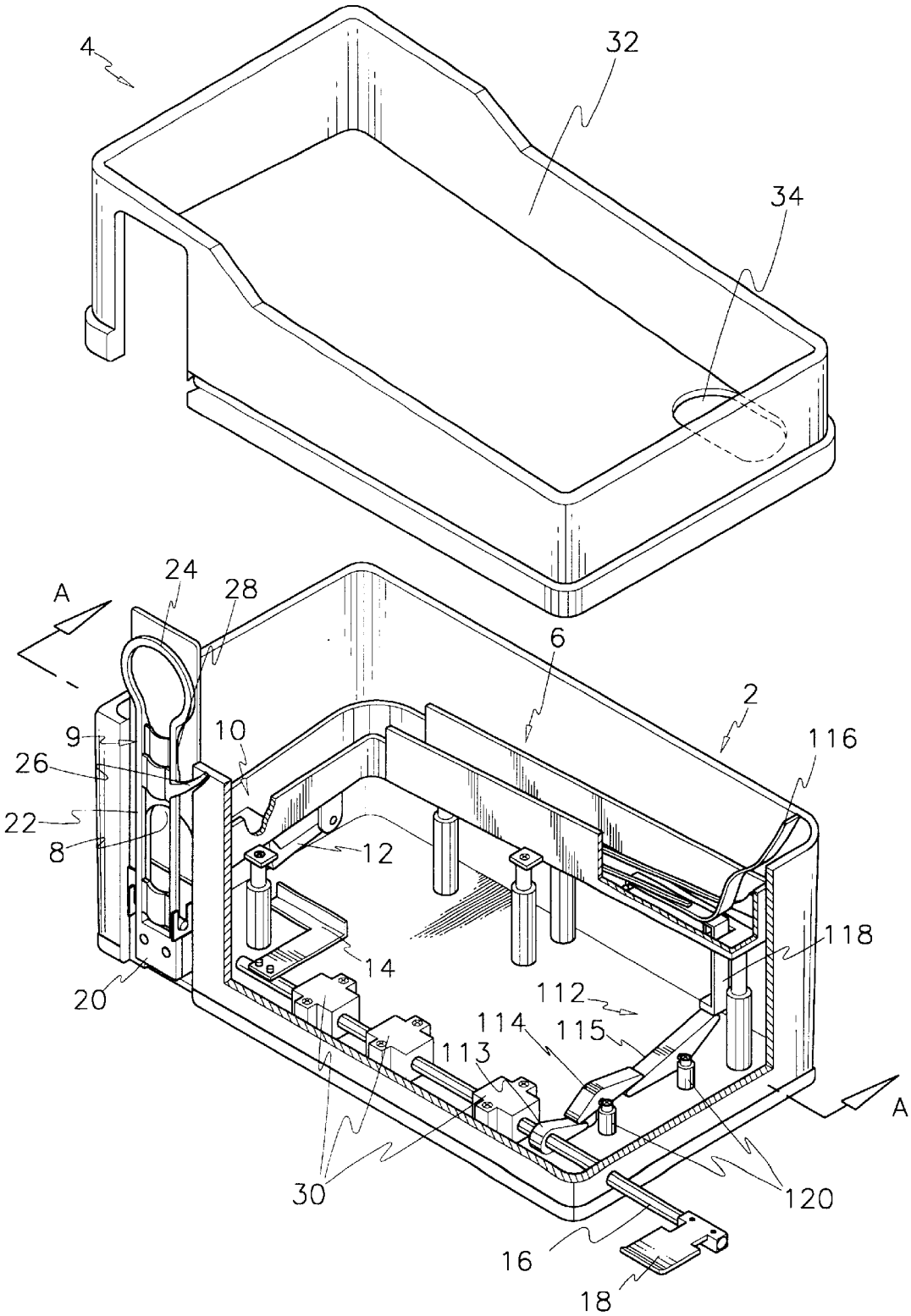
FIG. 5 is a partially sectional perspective view of a golf ball feeder according to a second preferred embodiment of the present invention.
Figure 6:
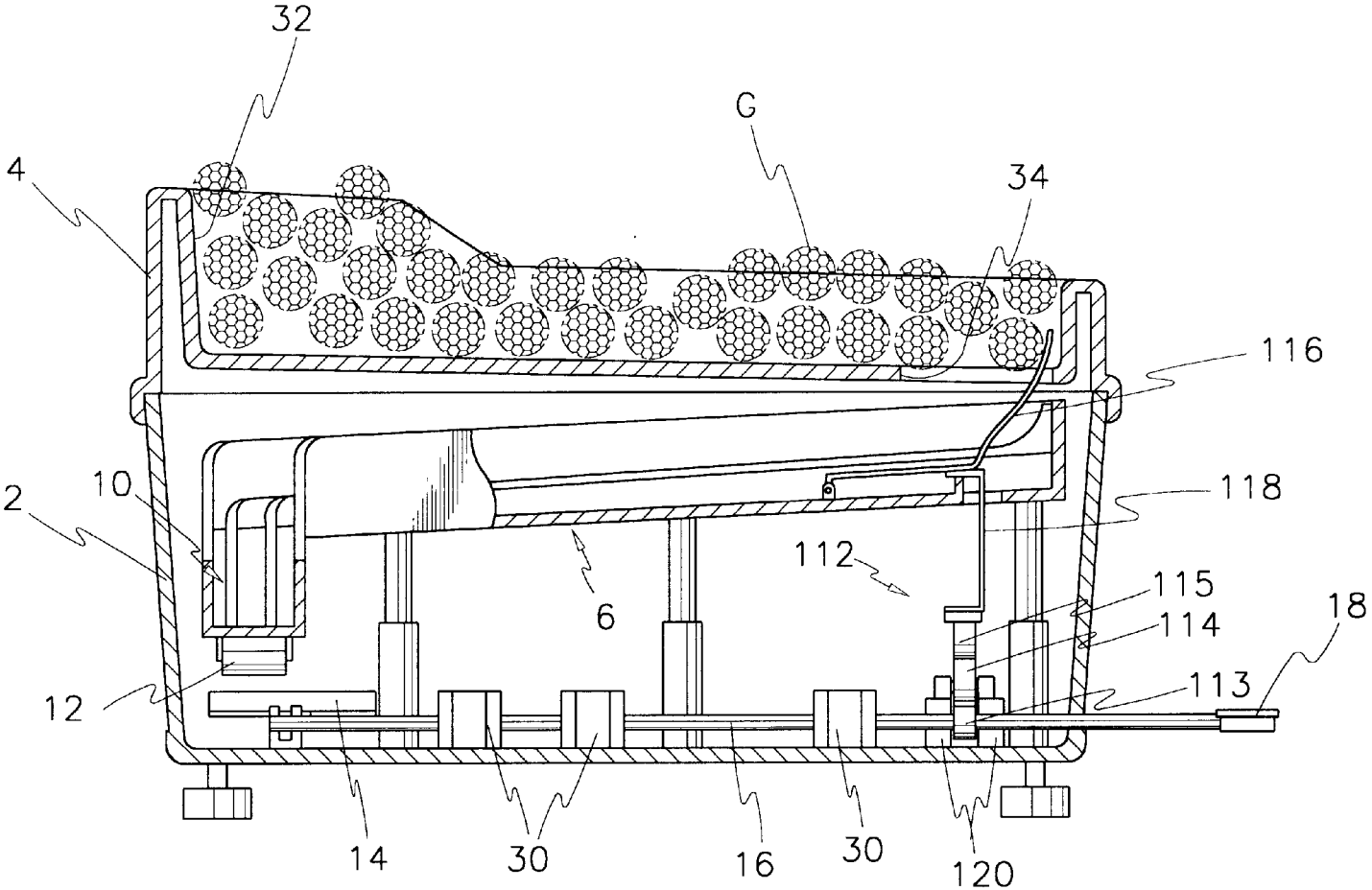
FIG. 6 is a sectional view of the golf ball feeder cut along the A—A line of FIG. 5.
Figure 7:
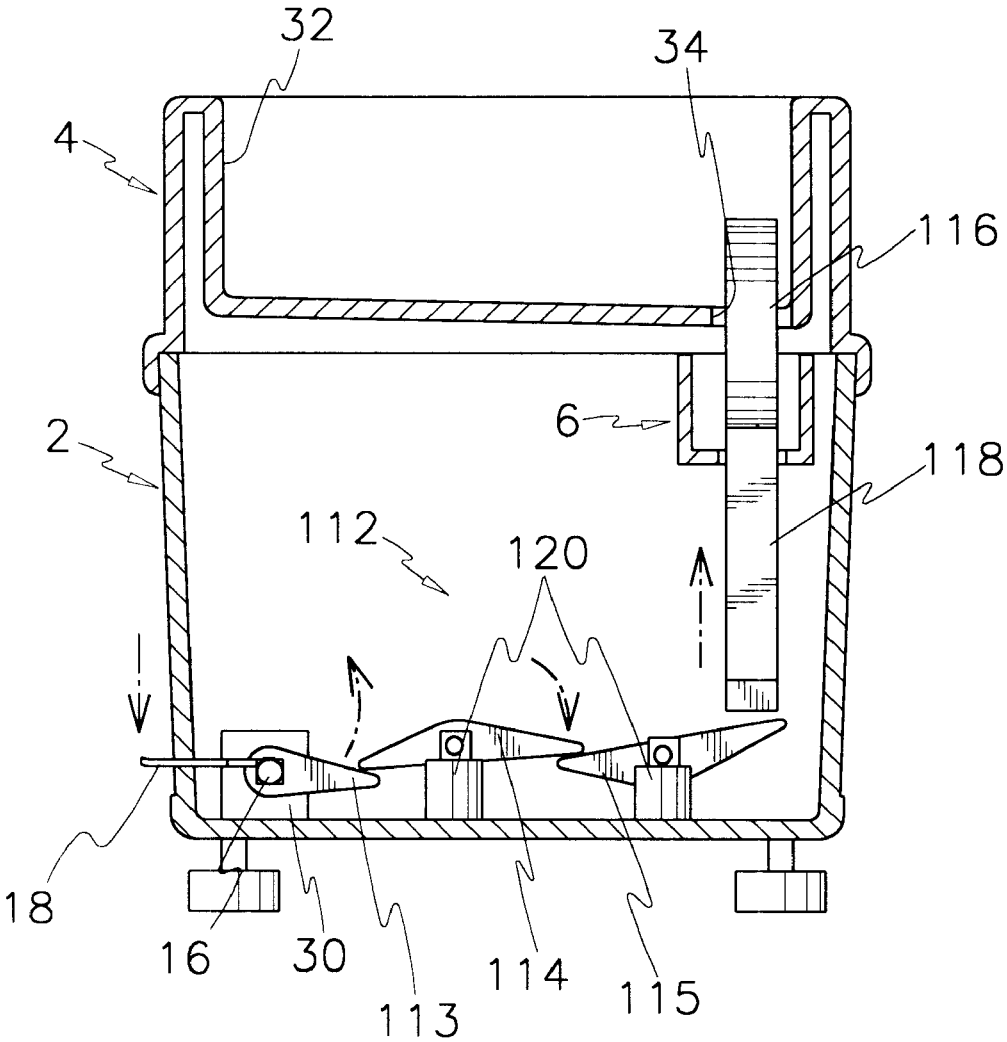
FIG. 7 is a side sectional view of the golf ball feeder shown in FIG. 5.

FIGS. 5 to 7 are views illustrating a golf ball feeder provided with a release mechanism for releasing the stuck state of golf balls according to a second preferred embodiment of the present invention.

As described earlier, the golf balls contained in the hopper 4 are liable to be stuck at the opening 34 because of their own tares or net weights working in a predetermined direction. Therefore, it is required that the stuck state of the golf balls be released by means of a separate mechanism. For this purpose, in this preferred embodiment, a release mechanism 112 is provided at a suitable place in the golf ball feeder. As shown in the figures, the power receptor 18 and the rod 16 co-work as the components of the release mechanism 112.

The release mechanism 112 includes a plurality of link members 113 to 115 dynamically connected to the rod 16 in a serial manner, a release plate 1 16 hinged at a lateral side of the guide chute 6, and a pushing member 118 having a top end fixed to a bottom side of the release plate 116 in a body and a bottom end contacting a top portion of the neighboring link member 115.

Suitable numbers of supports 120 are provided at the bottom side of the case 2 and each of the link members 113 to 115 is hinged at the corresponding support 120 such that it can be rotated.

As shown in FIG. 7, when an external force is applied onto the power receptor 18 formed on the frontal end of the rod 16, the link members 113 to 115 dynamically connected to the rod 16 are sequentially rotated in short and large dashed arrow directions. At this time, the rotational force of the final link member 115 is transmitted onto the pushing member 118. Subsequently, the release plate 116 combined with the pushing member 118 moves upward and, at the same time, a free end of the release plate 116 passes through the opening 34 of the hopper 4 to thereby release the stuck state of the golf balls G shown in FIG. 6.

When the applied external force is extinguished, the components of the release mechanism return to their original positions by their own weights.

As described above, in the golf ball feeder, the overall structure can be simplified because it does not need to incorporate motor and its accessories.

Furthermore, the golf ball feeding operation is performed merely by one-touch movement of the golf player, convenient use and noise-free effects can be obtained.

In addition, since the release operation is simultaneously performed with the ball feeding operation, delay in the ball feeding time does not occur.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A golf ball feeder comprising:

a hopper for storing a plurality of golf balls therein, the hopper having an opening;

a guide chute positioned below the hopper to receive the golf balls from the opening of the hopper, the golf balls flowing along the guide chute;

an outlet chute connected to the guide chute to deliver the golf balls flowed from the guide chute to the outside;

a stopper formed in a boundary region between the guide chute and the outlet chute to stop flowing of the golf balls;

a golf ball lifting unit positioned below the stopper to free one of the golf balls from the stopper; and a tee up member hinged at an outlet side of the outlet chute to receive the golf ball from the outlet chute and put the golf ball on a tee;

wherein the golf ball lifting unit comprises a rod capable of rotating by an external force, a pushing member fixed to the rod to be rotated with the rod as a single unit, and a lift dynamically connected to the pushing member to be elevated by the rotation of the pushing member and to free the golf ball from the stopper.

2. A golf ball feeder comprising:

a hopper for storing a plurality of golf balls therein, the hopper having an opening and the golf balls capable of being stuck in the hopper;

a guide chute positioned below the hopper to receive the golf balls from the opening of the hopper, the golf balls flowing along the guide chute;

an outlet chute connected to the guide chute to deliver the golf balls flowed from the guide chute to the outside;

a stopper formed in a boundary region between the guide chute and the outlet chute to stop flowing of the golf balls;

a golf ball lifting unit positioned below the stopper to free one of the golf balls from the stopper, the golf ball lifting unit having a rod;

a tee up member hinged at an outlet side of the outlet chute to receive the golf ball from the outlet chute and put the golf ball on a tee; and a golf ball releasing unit positioned below the opening of the hopper to release the stuck state of golf balls in connection with the rod of the golf ball lifting unit;

wherein the golf ball releasing unit comprises a plurality of link members dynamically connected to the rod of the golf ball lifting unit to be rotated, a pushing member moved up and down by the rotation of the link members, and a release plate fixed to the pushing member to be moveable with the pushing member as a single unit, the release plate having an end hinged at the guide chute and an opposite free end for releasing the stuck state of the golf balls.

* * * * *